United States Patent [19]

Fischlmayr

[11] 4,067,561

[45] Jan. 10, 1978

[54] ARRANGEMENT FOR PICKLING BUNDLED MATERIAL

[75] Inventor: Ernst Fischlmayr, Kronstorf, Austria

[73] Assignee: Vereinigte Osterreichische Eisen- und Stahlwerke - Alpine Montan Aktiengesellschaft, Linz, Austria

[21] Appl. No.: 751,147

[22] Filed: Dec. 16, 1976

[30] Foreign Application Priority Data

| | | |
|---|---|---|
| Dec. 22, 1975 | Austria | 9730/75 |
| Aug. 17, 1976 | Austria | 6100/76 |

[51] Int. Cl.[2] ..... B66D 3/00

[52] U.S. Cl. ..... 269/46; 134/154

[58] Field of Search ..... 269/46, 327; 108/24; 294/85; 134/154, 182, 157

[56] References Cited

U.S. PATENT DOCUMENTS

| | | | |
|---|---|---|---|
| 3,341,191 | 9/1967 | Pianowski | 269/46 |
| 3,592,690 | 7/1971 | Schoffmann | 134/157 |

*Primary Examiner*—Robert C. Watson

*Attorney, Agent, or Firm*—Brumbaugh, Graves, Donohue & Raymond

[57] ABSTRACT

A pickling hook arrangement for pickling bundled material has a first leg and a second leg to give it a U-like shape and a suspension device to which the first leg is secured. The second leg serves as support for the bundled material. At least the first leg is downwardly inclined for guiding off liquid. Connection devices are provided to connect the first leg with the suspension device, and covering devices are provided on the first leg and on the connection devices to protrude beyond the cross-section thereof to prevent liquid from dripping onto the bundled material.

14 Claims, 7 Drawing Figures

ARRANGEMENT FOR PICKLING BUNDLED MATERIAL

BACKGROUND OF THE INVENTION

The invention relates to an arrangement for pickling bundles of wires, sheets or plates with a U-shaped pickling hook having one leg secured to a suspension means and the other leg designed as a support for the bundles.

Arrangements of this kind are known, e.g., from Austrian Pat. No. 290,245 (corresponds to U.S. Pat. No. 3,592,690 and British Pat. No. 1,243,639, respectively). Advantageously, they are resiliently suspended and allowed to oscillate with the help of oscillation generators. With these arrangements pickling liquid gets in between the coils of the bundles and very uniform pickling results are obtained.

One difficulty with these prior arrangements, however, is that after the pickling hook carrying the bundle has been lifted out of the treatment bath, pickling liquid or condensation liquid drips from the leg that had been immersed or from the connecting means between the suspension means and the pickling hook, onto the material being treated, whereby the surface of the latter is negatively affected. Colour changes occur on the material being treated, and starting points for increased aggression by corrosion may be created. When very sensitive or delicate materials are pickled or treated otherwise, the only known way to prevent drops from getting on the material treated is to wipe the leg and the other parts arranged above the bundle with a cloth after the final immersion. Of course, this solution is very complicated and unsatisfactory, and therefore it would be desirable to overcome the present difficulties by finding an improved shape for the pickling hook.

SUMMARY OF THE INVENTION

Thus it is the object of the present invention to guide the run-off of pickling or condensation liquid by giving a specific shape to the pickling hook (i.e. to those parts of the pickling hook which are arranged above the material being treated, including the connection means to the suspension means) without the occurrence of an uncontrolled dripping of liquid onto the pickling material.

According to the invention, this object is achieved in that the leg secured to the suspension means, and, if desired, the lower side of the leg formed as a support for the bundle, are designed to extend downwardly inclined so as to lead the liquid off of them. The connection means to the suspension means, as well as the leg itself, are provided with covering parts protruding beyond the cross-section thereof, which parts prevent liquid from dripping onto the pickling material.

Advantageously, the downward inclination of the leg or legs is between 1 : 14 and 1 : 5 corresponding to an angle of between 4° and 11°. In this range of inclination the liquid runs off perfectly without the formation of drops.

An essential characteristic of the covering is that the lower rim of the leg protrudes in a flange-like manner on both sides in order to form one primary channel each.

Another essential characteristic is that the connection means to the suspension means are covered by a drip ledge secured to the suspension means and slightly downwardly inclined, the ends of the drip ledge being arranged above a primary channel.

Advantageously, the transverse part of the pickling hook connecting the inclined leg with the support of the bundle has a sword-shaped projection.

According to a preferred embodiment, the flange-like extensions forming the primary channels extend beyond the back end of the transverse part of the pickling hook into the region of the sword-shaped projection.

A further characteristic for making the covering complete is that the transverse part is provided with lateral ledge-shaped extensions for forming secondary channels in order to guide liquid arriving from the lower face of the leg to the outer contour of the hook and into the region of the sword-shaped projection.

In order to guarantee perfect run-off of the pickling and condensation liquid from the leg designed as the support of the bundle, even if the surface of that leg is rough and corroded due to the influence of pickling liquid, the lower rim of that leg advantageously protrudes in a flange-like manner at both sides for forming one drip channel each.

BRIEF DESCRIPTION OF THE DRAWINGS

The invention shall now be described in more detail by way of two embodiments and with reference to the accompanying drawings, wherein.

DESCRIPTION OF EXEMPLARY EMBODIMENTS

Figure 1:
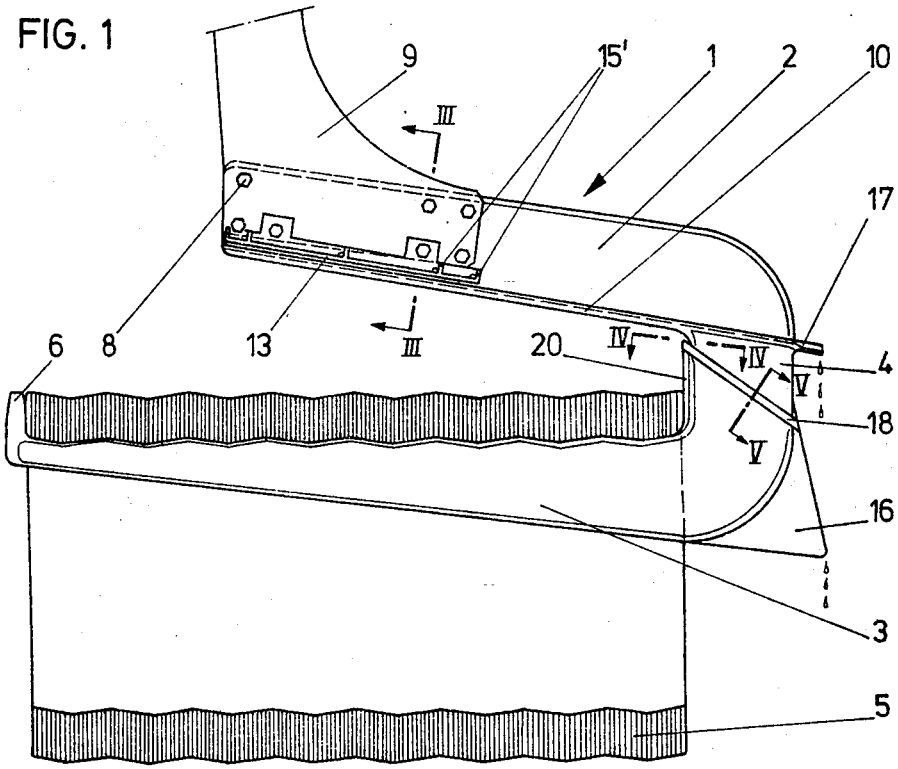
FIG. 1 is a front view of a pickling hook according to the present invention.
Figure 2:
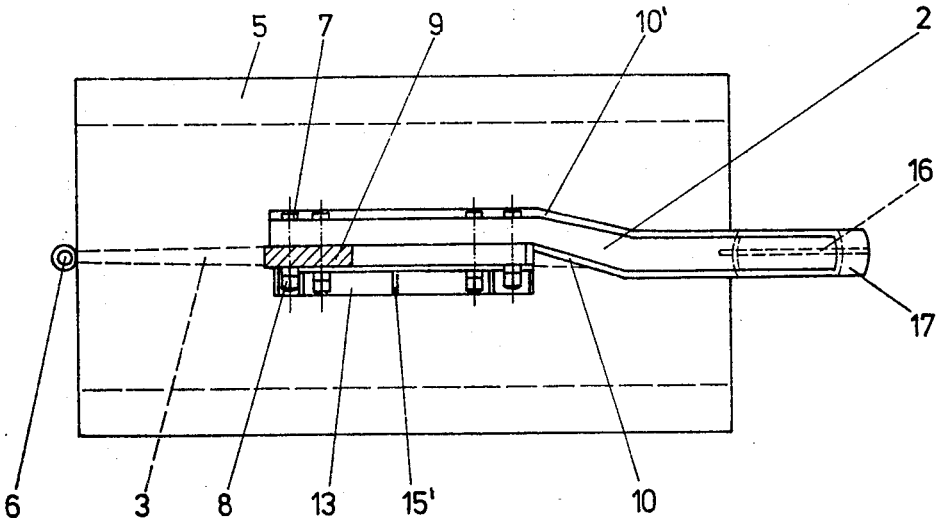
FIG. 2 is a top view of the arrangement of FIG. 1 according to one embodiment.
Figure 3:
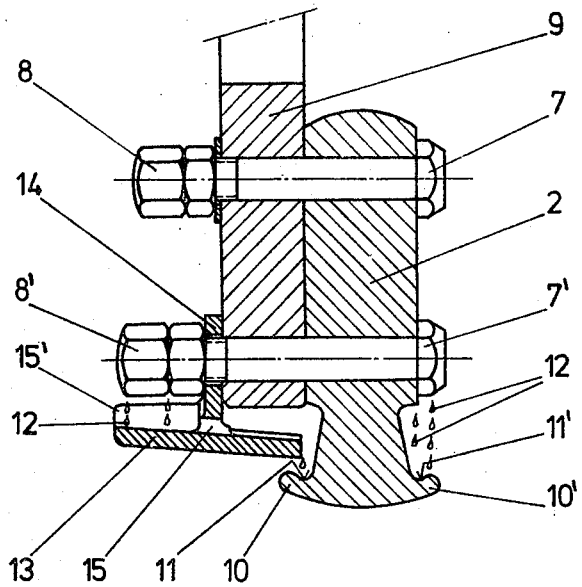
FIG. 3 shows a section along line III—III of FIG. 1.
Figure 5:
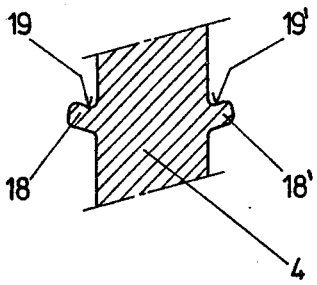
FIG. 5 shows a section along line V—V of FIG. 1.
Figure 4:
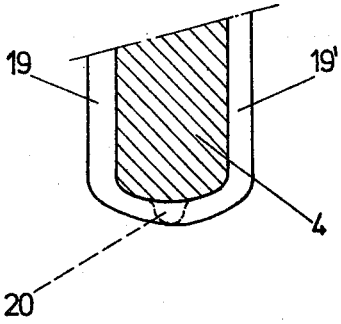
FIG. 4 shows a section along line IV—IV of FIG. 1.

In the Figures, a pickling hook 1 comprises a leg 2, a leg 3 designed as a support for a bundle of material to be pickled, and a transverse part 4 connecting the legs. The support leg 3, which accommodates a wire bundle 5, is slightly corrugated at upper surface and has an upwardly protruding rim ledge 6, in order to prevent the bundle from sliding off. The leg 2 and the lower side of the support leg 3 are designed to extend in a downwardly inclined direction in order to lead the pickling liquid off of these parts. The leg 2 is secured to a suspension means 9 by means of screws 7 and 7' and nuts 8 and 8', as can be seen in FIGS. 1-3. The pickling hook is provided with an oscillation generator not illustrated, e.g. an unbalance motor. The portions of the pickling hook arranged above the wire bundle 5 are provided with covers according to the invention, which covers protect the pickling material arranged therebelow from pickling liquid that may drip on it. For this purpose, the lower rim of the leg 2 is widened at both sides by flange-like extensions 10 and 10' which have a slight conically upward cross section (FIG. 3). In this way primary channels 11 and 11' are formed. The flange-like extensions extend transverse to the leg beyond the cross-section of the leg as well as beyond the screw heads 7 and 7' so that liquid particles 12 dripping down from the screw heads are caught in the channel 11'. For covering the suspension means 9 and the nuts 8 and 8' a drip ledge 13 is secured to the suspension means below it and the nuts, i.e. the ledge is secured to the suspension means with the help of a shield 14 provided with a bore that is penetrated by the screws 7. In the lower portion of the shield, conduits 15 are provided. Between them, ribs 15' can be arranged. The drip ledge 13 is slightly inclined; it extends over the cross-section of the nuts 8 and 8' and the cross-section of the suspension means, and ends slightly above the primary channel 11. Liquid 12 dripping from the suspension means and the connection means (i.e. screws 7 and 7', and nuts 8 and 8') is thus collected directly by primary channel 11' and is led to primary channel 11 by the conduits 15.

The transverse part 4 of the U-shaped pickling hook connecting the leg 2 with the support leg 3 has a sword-shaped projection 16. The flanges 10 and 10' are extended beyond the end of the transverse part 4 and united to form a channel 17. From the end of the channel 17 the liquid drips onto the sword-shaped projection 16 and flows off from there.

In order to collect and lead off the liquid arriving from the lower face of the leg, without the bundle coming into contact with that liquid, the transverse part 4 is designed with ledge-shaped extensions 18 and 18' surrounding the transverse part 4, whereby secondary channels 19 and 19' are formed. They extend in a downwardly inclined manner to a point below and behind the outer contour of part 4 where they run into the sword-shaped projection 16. At the inner side of the transverse part 4 there is provided a narrow contact ledge 20. This has the effect of preventing the coils of the bundle that contact the inner side of the hook from being wetted by the run-off liquid.

The arrangement according to the invention works, as illustrated, in such a manner that the liquid particles dripping down are collected by the covering means, i.e. the drip ledge 13 guides the liquid dripping down from the suspension means and the nuts of the connection means into the primary channel 11, the primary channel 11' collects the liquid dripping down from the screws 7 of the connection means and the upper parts of the leg 2, the mutual channel 17 collects the liquid from the two primary channels, and finally the secondary channels 19 and 19' collect and lead off the liquid arriving from the inner side of the leg 2.

According to a preferred embodiment shown in FIG. 2, the leg is designed offset, so that the support arm 3 accommodating the bundle lies in the plane of gravity of the bundle and no bending moments act on the suspension means.

Figure 7:
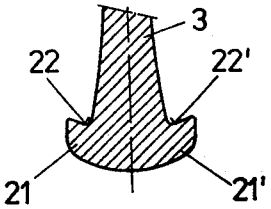
FIG. 7 is a section along line VII—VII of FIG. 6.
Figure 6:
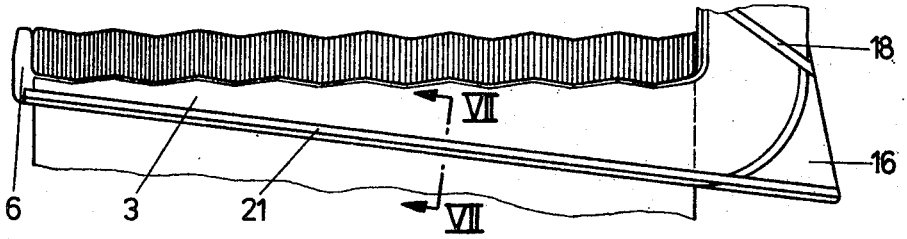
FIG. 6 shows a detail in a manner analogous to FIG. 1 according to a further embodiment of the invention.

According to the embodiment illustrated in FIGS. 6 and 7, the inclined lower rim of support leg 3, designed as the support for the bundle, is provided with flange-like, slightly conical upwardly directed extensions 21 and 21' at both sides thereof, whereby drip channels 22 and 22' are formed. These drip channels extend to the tip of the sword shaped projection 16. They provide for a drip-free run-off of pickling and condensation liquid even if the surface of leg 3 is rough and corroded after a longer period of use.

What I claim is:

1. In an arrangement for pickling bundled material with a U-shaped pickling hook having a first leg and a second leg and a suspension means for supporting the hook, the first leg being secured to the suspension means and the second leg being designed as a support for the bundled material, the improvement comprising:

at least said first leg being designed to be downwardly inclined so as to guide off liquid, connection means for connecting the first leg with the suspension means, and covering means provided on said connection means as well as on said first leg and designed to protrude beyond the cross section thereof to prevent liquid from dripping onto the bundled material by causing it to run-off the hook.

2. An arrangement as set forth in claim 1, wherein the bundled material is bundled wire.

3. An arrangement as set forth in claim 1, wherein the bundled material is bundled sheets of material.

4. An arrangement as set forth in claim 1, wherein the bundled material is bundled plates of material.

5. An arrangement as set forth in claim 1, wherein the lower side of the second leg is designed to extend be downwardly inclined so as to lead off liquid.

6. An arrangement as set forth in claim 1, wherein said first leg is downwardly inclined at a ratio of between 1 : 14 and 1 : 5 corresponding to an angle of between 4° and 11°.

7. An arrangement as set forth in claim 5, wherein the lower side of said second leg is downwardly inclined at a ratio of between 1 : 14 and 1 : 5 corresponding to an angle of between 4° and 11°.

8. An arrangement as set forth in claim 1, wherein the covering means include flange-like extensions provided on both sides of the first leg at its lower rim so as to form two primary channels, one on each side of the leg.

9. An arrangement as set forth in claim 8, wherein the covering means include a slightly downwardly inclined drip ledge secured to the suspension means, the drip ledge covering at least part of the connection means and ending above one of the primary channels.

10. An arrangement as set forth in claim 1, wherein a transverse part is provided to connect the first leg with the second leg, said transverse part having a sword-shaped projection.

11. An arrangement as set forth in claim 8, wherein a transverse part is provided to connect the first leg and the second leg, said transverse part having a sword-shaped projection, the flange-like extensions each forming the two primary channels into a single primary channel extending into the region of the sword-shaped projection.

12. An arrangement as set forth in claim 10, wherein said transverse part is provided with lateral ledge-like extensions for forming secondary channels for guiding liquid arriving from the lower side of the first leg to the outer contour of the pickling hook and into the region of the sword-shaped projection.

13. An arrangement as set forth in claim 1, wherein a transverse part is provided for connecting said first leg with said second leg, the inner side of said transverse part being provided with a narrow contact ledge for preventing said bundled material from being wetted by the run-off liquid.

14. An arrangement as set forth in claim 1, wherein both sides of the second leg at its lower rim are provided with flange-like extensions so as to form two drip ledges, one on each side of the leg.

* * * * *

UNITED STATES PATENT AND TRADEMARK OFFICE

CERTIFICATE OF CORRECTION

PATENT NO. : 4,067,561

DATED : Jan. 10, 1978

INVENTOR(S) : Ernst Fischlmayr

It is certified that error appears in the above-identified patent and that said Letters Patent are hereby corrected as shown below:

Col. 2, line 44, after "at" insert --its--;

Col. 3, line 46, "leg" should read --hook--, and "arm" should read --leg--; and

Col. 4, line 19, delete "extend".

Signed and Sealed this

Ninth Day of May 1978

[SEAL]

Attest:

RUTH C. MASON
Attesting Officer

LUTRELLE F. PARKER
Acting Commissioner of Patents and Trademarks